US010169936B2

(12) United States Patent
Zhevelev et al.

(10) Patent No.: US 10,169,936 B2
(45) Date of Patent: Jan. 1, 2019

(54) COMBINED MOTION DETECTION AND ACCESS CONTROL SYSTEM AND METHOD

(71) Applicant: Tyco Fire & Security GmbH, Neuhausen am Rheinfall (CH)

(72) Inventors: Boris Zhevelev, Rishon le Zion (IL); Tuviya Katz, Nes Ziyyona (IL); Avi Manela, Hod Hasharon (IL)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 15/193,375

(22) Filed: Jun. 27, 2016

(65) Prior Publication Data

US 2017/0372538 A1 Dec. 28, 2017

(51) Int. Cl.
*G07C 9/00* (2006.01)

(52) U.S. Cl.
CPC ..... *G07C 9/00031* (2013.01); *G07C 9/00103* (2013.01); *G07C 9/00111* (2013.01); *G07C 9/00119* (2013.01); *G07C 9/00309* (2013.01); *G07C 9/00571* (2013.01); *G07C 2209/64* (2013.01)

(58) Field of Classification Search
CPC ..... G07C 9/00031; G07C 9/00111; G07C 9/00571; G07C 9/00103
USPC ..... 340/5.2
See application file for complete search history.

(56) References Cited

U.S. PATENT DOCUMENTS 5,541,585 A 7/1996 Duhame et al.
2010/0245087 A1* 9/2010 Gerner ..... G07C 9/00111 340/541
2011/0128145 A1* 6/2011 Todd ..... G06F 19/323 340/539.11

FOREIGN PATENT DOCUMENTS

| | | |
|---|---|---|
| EP | 1 026 354 | 8/2000 |
| EP | 2 234 072 | 9/2010 |
| WO | WO 2014005651 | 1/2014 |

OTHER PUBLICATIONS

Extended European Search Report dated Nov. 14, 2017, from European Patent Application No. 17178197.4, filed on Jun. 27, 2017. 7 pages.

* cited by examiner

*Primary Examiner* — Vernal U Brown
(74) *Attorney, Agent, or Firm* — HoustonHogle LLP

(57) ABSTRACT

A combined motion detection and access control method and system, the system including a processor for receiving an indication of motion detection within a premises and for ascertaining an area within which the motion was detected; at least one transmitter operable, responsive to receiving, from the processor, an indication of the area, for broadcasting, within the area, an encoded identification of the area; a transceiver associated with an individual and operable for receiving the encoded area identification and, responsive thereto, for broadcasting an encoded identification of the individual and the encoded area identification; and at least one receiver operable for receiving the encoded identification of the individual and the encoded area identification and for communicating the encoded identification of the individual and the encoded area identification to the processor which is operable, thereto, for ascertaining whether the individual is allowed access to the area encoded in the encoded area identification.

17 Claims, 3 Drawing Sheets

COMBINED MOTION DETECTION AND ACCESS CONTROL SYSTEM AND METHOD

FIELD OF THE INVENTION

The present invention relates to motion detection systems and access control systems.

BACKGROUND OF THE INVENTION

Various types of motion detection systems and access control systems are known in the art. One major shortcoming of currently available motion detection systems is that they are typically incapable of differentiating between detecting motion of individuals who are authorized to access a particular premises or a particular area of the premises, and motion of individuals who not authorized to access the particular premises or the particular area of the premises. The present invention seeks to provide a combined motion detection system and access control system.

SUMMARY OF THE INVENTION

The present invention seeks to provide combined motion detection and access control system and method.

There is thus provided in accordance with a preferred embodiment of the present invention a combined motion detection and access control method including receiving an indication of motion detection within a premises and ascertaining an indication of an area of the premises within which the motion was detected; responsive to ascertaining the area of the premises within which the motion was detected, broadcasting, within the area, an encoded identification of the area; receiving, by a mobile transceiver associated with an individual, the broadcasted encoded area identification; responsive to receiving the encoded area identification, broadcasting, by the mobile transceiver associated with the individual, an encoded identification of the individual together with the encoded area identification; receiving the broadcasted encoded identification of the individual together with the broadcasted encoded area identification; responsive to receiving the encoded identification of the individual together with the encoded area identification, ascertaining whether the individual is allowed access to the area of the premises encoded in the encoded area identification.

Preferably, the method also includes, responsive to ascertaining that the individual is not allowed access to the area of the premises encoded in the encoded area identification, providing an indication of unauthorized access to the area.

Preferably, the indication of motion detection is provided by a motion detector deployed within a particular area of the premises. Preferably, ascertaining an area of the premises within which the motion was detected is achieved by ascertaining an area of the premises in which the motion detector is deployed.

In accordance with this preferred embodiment of the present invention, broadcasting, by the mobile transceiver associated with the individual, an encoded identification of the individual together with the encoded area identification is operative to attest to the presence of the individual in the area of the premises encoded in the encoded area identification.

There is also provided in accordance with another preferred embodiment of the present invention a combined motion detection and access control system including a processor operable for receiving an indication of motion detection within a premises and ascertaining an area of the premises within which the motion was detected; at least one transmitter communicating with the processor and operable, responsive to receiving, from the processor, an indication of the area of the premises within which the motion was detected, for broadcasting, within the area, an encoded identification of the area; at least one mobile transceiver being associated with an individual and being operable for receiving the encoded area identification broadcasted by the at least one transmitter and, responsive to receiving the encoded area identification, for broadcasting an encoded identification of the individual together with the encoded area identification; and at least one receiver operable for receiving the broadcasted encoded identification of the individual together with the broadcasted encoded area identification and for communicating the encoded identification of the individual together with the encoded area identification to the processor; wherein the processor is operable, responsive to receiving the encoded identification of the individual together with the encoded area identification for ascertaining whether the individual is allowed access to the area of the premises encoded in the encoded area identification.

Preferably, the processor is also operable, responsive to ascertaining that the individual is not allowed access to the area of the premises encoded in the encoded area identification, for providing an indication of unauthorized access to the area.

Preferably, the processor is a computing device. Preferably, the processor is a component of an intrusion detection system. Additionally or alternatively, the processor is a component of an enterprise-wide access control system.

Preferably, the processor communicates with an intrusion detection system. Additionally or alternatively, the processor communicates with an enterprise-wide access control system.

Preferably, the indication of motion detection is provided by a motion detector deployed within a particular area of the premises. Preferably, ascertaining an area of the premises within which the motion was detected is achieved by ascertaining an area of the premises in which the motion detector is deployed.

In accordance with this preferred embodiment of the present invention, broadcasting, by the at least one mobile transceiver being associated with the individual, an encoded identification of the individual together with the encoded area identification is operative to attest to the presence of the individual in the area of the premises encoded in the encoded area identification.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
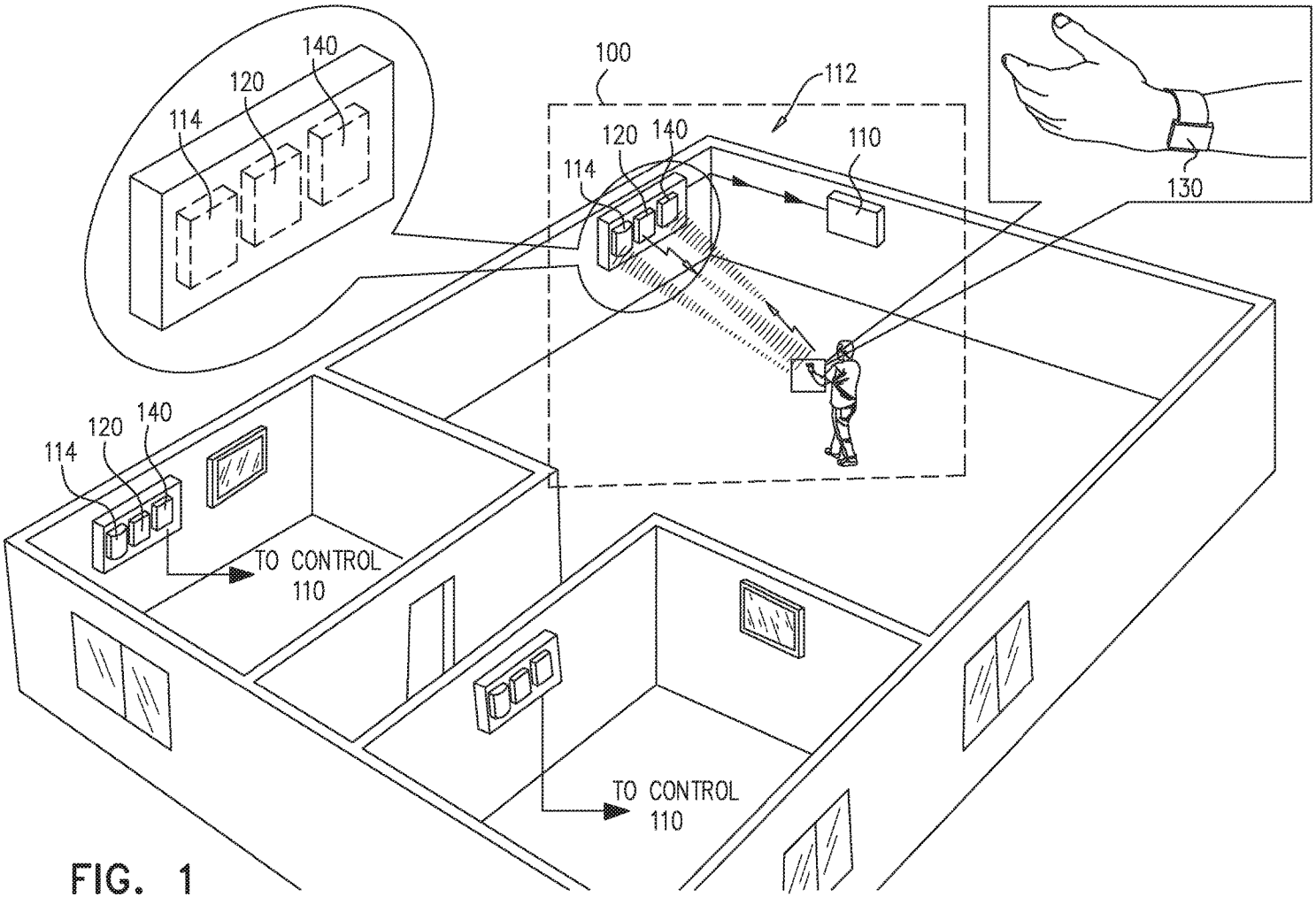
FIG. 1 is a simplified illustration of a combined motion detection and access control system, constructed and operative in accordance with a preferred embodiment of the present invention.

Reference is now made to FIG. 1, which is a simplified illustration of a combined motion detection and access control system, constructed and operative in accordance with a preferred embodiment of the present invention.

The combined motion detection and access control system 100 shown in FIG. 1 preferably includes a processor 110 operable for receiving an indication of motion detection within a premises 112 and for ascertaining an area of premises 112 within which the motion was detected. Processor 110 may be, for example, a computer or any other suitable computing device. It is appreciated that processor 110 may be, for example, a component of an intrusion detection system or an enterprise-wide access control system, or may communicate with an intrusion detection system or an enterprise-wide access control system.

Indications of motion detection received by processor 110 are preferably provided by any of a multiplicity of motion detectors 114 deployed within premises 112, each of motion detectors 114 being operable for detecting motion within a particular area of premises 112. Preferably, ascertaining an area of premises 112 within which the motion was detected by processor 110 is achieved by ascertaining which of motion detectors 114 has detected the motion.

System 100 preferably also includes a multiplicity of transmitters 120. Each of transmitters 120 preferably communicates with processor 110 and is preferably operable for broadcasting within a particular area of premises 112. In particular, responsive to receiving, from processor 110, an indication of an area of premises 112 within which motion was detected, a particular one of transmitters 120 operable for broadcasting within that particular area, preferably broadcasts an encoded identification of the area. It is appreciated that each of transmitters 120 may be combined with a corresponding one of motion detectors 114.

Individuals authorized to access premises 112 preferably carry a mobile transceiver 130 associated with the individual. Each of mobile transceivers 130 is preferably operable for receiving encoded area identifications broadcasted by transmitters 120. As described hereinabove, an encoded area identification is broadcasted within an area within which motion has been detected, therefore particular ones of mobile transceivers 130 associated with particular individuals residing in the area will preferably exclusively receive an encoded area identification broadcasted by a transmitter 120 configured to broadcast within that area.

Responsive to receiving an encoded area identification, each of mobile transceivers 130 is preferably operable for broadcasting an encoded identification of the individual associated therewith together with the encoded area identification, thereby attesting to the presence of the individual in the area of premises 112 encoded in the encoded area identification.

It is appreciated that mobile transceivers 130 may, for example, be worn by the individual in the form of a wrist-worn device as illustrated in FIG. 1, or may be carried by the individual on a key ring or embedded within a mobile communicating device carried by the user and associated therewith.

A receiver 140 is preferably provided for receiving encoded identifications of individuals together with encoded area identifications broadcasted by transceivers 130. It is appreciated that receiver 140 is preferably operable for communicating the encoded identifications of individuals and the encoded area identifications to processor 110. Additionally or alternatively, receiver 140 may be combined with processor 110 or with any of motion detectors 114.

It is a particular feature of the present invention that processor 110 is operable, responsive to receiving an encoded identification of an individual together with an encoded area identification for ascertaining whether the individual identified by the encoded identification is allowed access to the area of premises 112 encoded in the encoded area identification and, responsive to ascertaining that the individual is not allowed access to the area of premises 112 encoded in the encoded area identification, for providing an indication of unauthorized access to the area.

Figure 2:
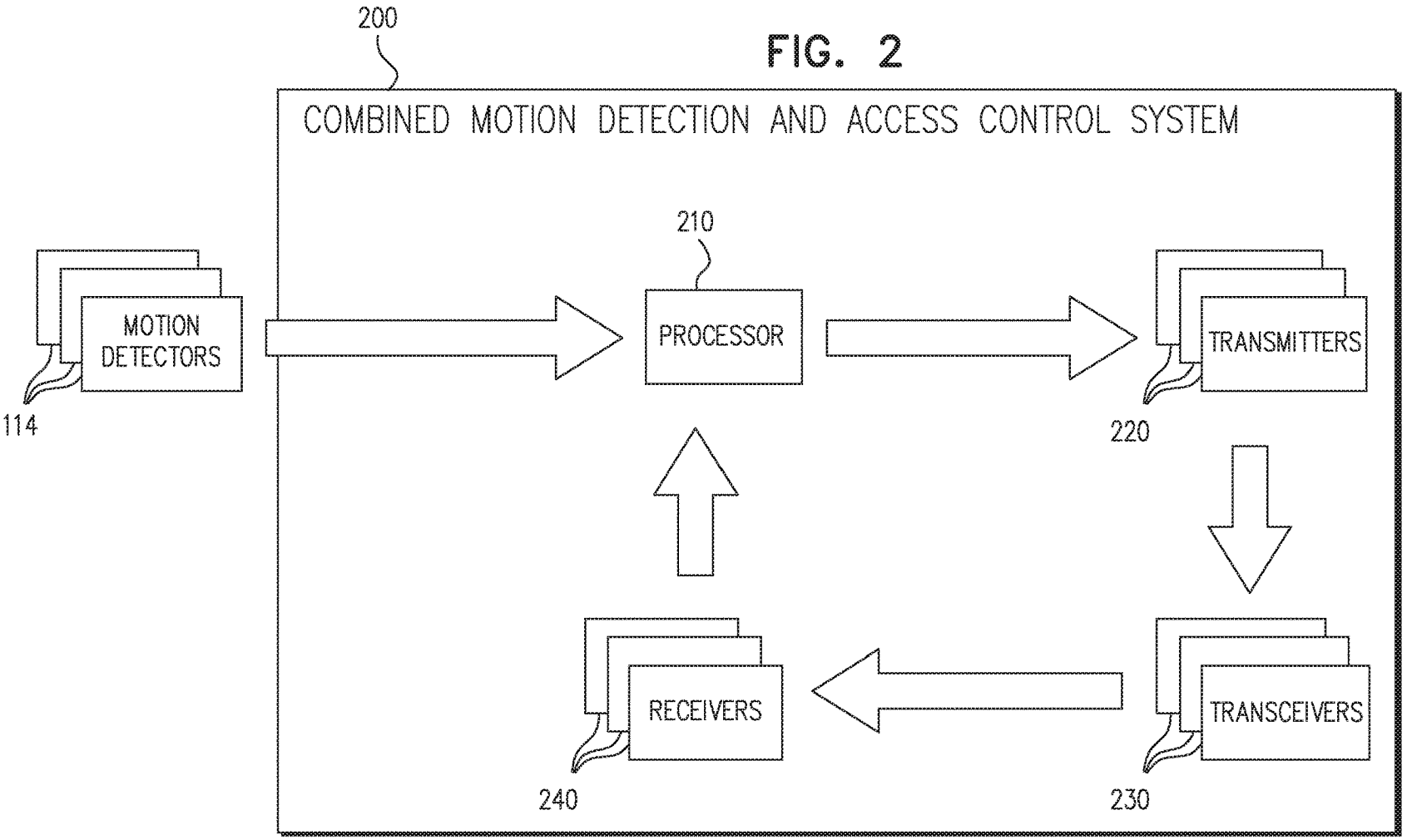
FIG. 2 is a simplified block diagram illustration of the combined motion detection and access control system of FIG. 1.

Reference is now made to FIG. 2, which is a simplified block diagram illustration of the combined motion detection and access control system of FIG. 1. As shown in FIG. 2, the combined motion detection and access control system 200 of FIG. 2 preferably includes processor 210 operable for receiving an indication of motion detection within a premises and ascertaining of an area of the premises within which the motion was detected. It is appreciated that as described hereinabove with reference to FIG. 1, indications of motion detection received by processor 210 are preferably provided by any of a multiplicity of motion detectors 114.

System 200 also preferably includes a multiplicity of transmitters 220 communicating with processor 210, each of transmitters 220 being operable, responsive to receiving, from processor 210, an indication of an area of the premises within which motion was detected, for broadcasting, within the area, an encoded identification of the area. It is appreciated that each of transmitters 220 may be combined with a corresponding one of motion detectors 114.

System 200 yet further preferably includes a plurality of mobile transceivers 230, each of mobile transceivers 230 being associated with an individual and being operable for receiving encoded area identifications broadcasted by transmitters 220 and responsive to receiving an encoded area identification, for broadcasting an encoded identification of the individual together with the encoded area identification.

A plurality of receivers 240 are preferably provided for receiving broadcasted encoded identifications of individuals together with broadcasted encoded area identifications, and for communicating the encoded identifications of individuals together with the encoded area identifications to processor 210. Processor 210 is then operable for ascertaining whether an individual identified by the encoded identification is allowed access to the area of the premises encoded in the encoded area identification. Responsive to ascertaining that the individual is not allowed access to the area of the premises encoded in the encoded area identification, processor 210 is preferably operable for providing an indication of unauthorized access to the area.

It is appreciated that receivers 240 may be combined with processor 210 or with any of motion detectors 114.

Figure 3:
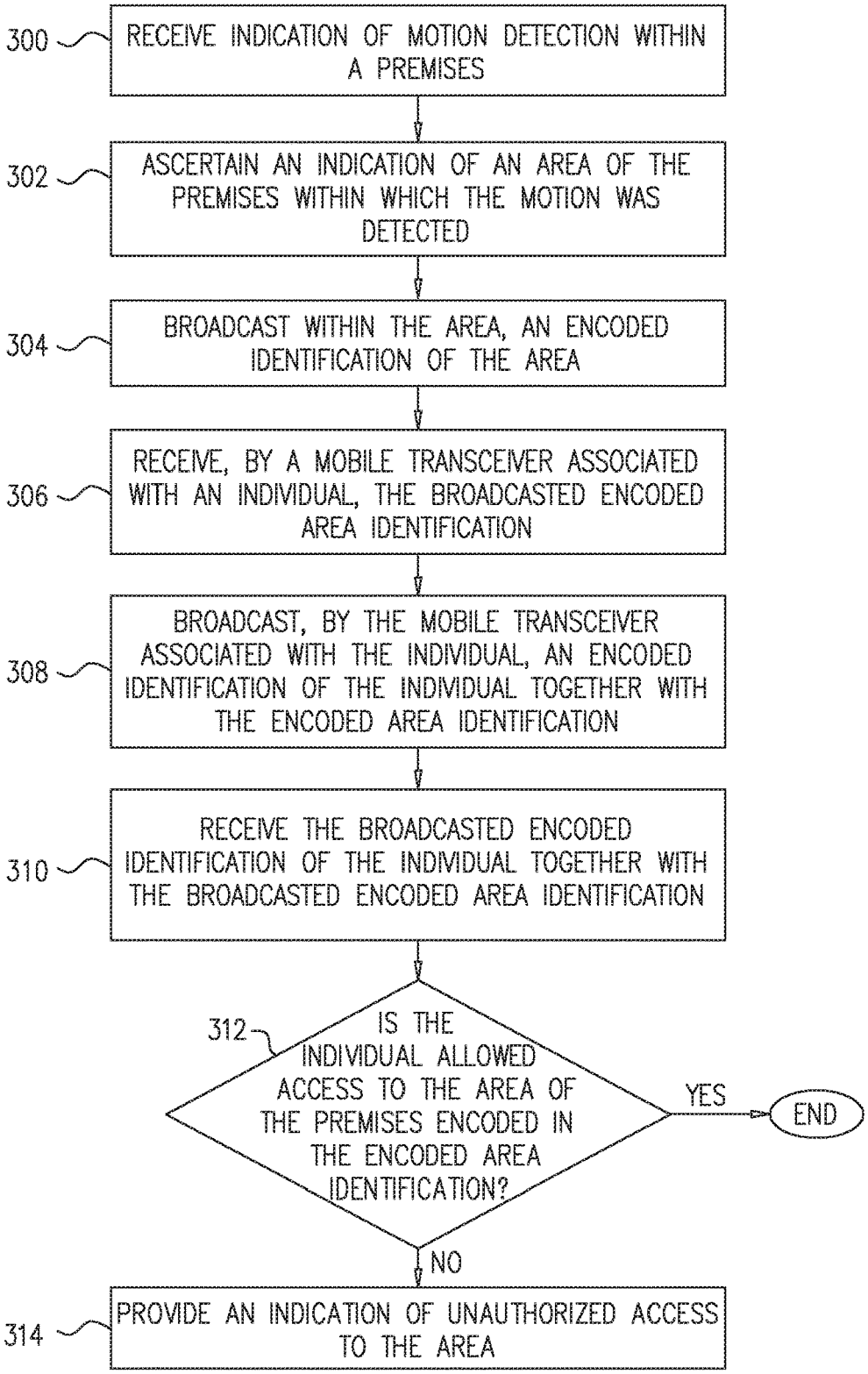
FIG. 3 is a simplified flowchart indicating steps in the operation of the combined motion detection and access control system of FIGS. 1 and 2

Reference is now made to FIG. 3, which is a simplified flowchart indicating steps in the operation of the combined motion detection and access control system of FIGS. 1 and 2. As shown in FIG. 3, the method initially includes receiving an indication of motion detection within a premises (300) and ascertaining an indication of an area of the premises within which the motion was detected (302). Responsive to ascertaining an area of the premises within which the motion was detected, the method then includes broadcasting, within the area, an encoded identification of the area (304) and receiving, by a mobile transceiver associated with an individual, the broadcasted encoded area identification (306).

Responsive to receiving the encoded area identification, the method preferably includes broadcasting, by the mobile transceiver associated with the individual, an encoded identification of the individual together with the encoded area identification (308) and receiving the broadcasted encoded identification of the individual together with the broadcasted encoded area identification (310).

Responsive to receiving the encoded identification of the individual together with the encoded area identification, the method includes ascertaining whether the individual is allowed access to the area of the premises encoded in the encoded area identification (312). Responsive to ascertaining that the individual is not allowed access to the area of the premises encoded in the encoded area identification, the method includes providing an indication of unauthorized access to the area (314).

It will be appreciated by persons skilled in the art that the present invention is not limited by what has been particularly shown and described hereinabove. Rather the scope of the present invention includes both combinations and subcombinations of the various features described hereinabove as well as modifications thereof which would occur to persons skilled in the art upon reading the foregoing description and which are not in the prior art.

The invention claimed is:

1. A combined motion detection and access control method comprising:

receiving an indication of motion detection within a premises and ascertaining an indication of an area of said premises within which said motion was detected;

responsive to said ascertaining said area of said premises within which said motion was detected, broadcasting, within said area within which said motion was detected, an encoded identification of said area within which said motion was detected;

receiving, by a mobile transceiver associated with an individual, said broadcasted encoded area identification of said area within which said motion was detected;

responsive to said receiving said encoded area identification of said area within which said motion was detected, broadcasting, by said mobile transceiver associated with said individual, an encoded identification of said individual together with said encoded area identification of said area within which said motion was detected;

receiving said broadcasted encoded identification of said individual together with said broadcasted encoded area identification of said area within which said motion was detected; and responsive to said receiving said encoded identification of said individual together with said encoded area identification of said area within which said motion was detected, ascertaining whether said individual is allowed access to said area of said premises encoded in said encoded area identification within which said motion was detected.

2. A combined motion detection and access control method according to claim 1 and also comprising, responsive to said ascertaining that said individual is not allowed access to said area of said premises encoded in said encoded area identification, providing an indication of unauthorized access to said area.

3. A combined motion detection and access control method according to claim 1 and wherein said indication of motion detection is provided by a motion detector deployed within a particular area of said premises.

4. A combined motion detection and access control method according to claim 3 and wherein said ascertaining an area of said premises within which said motion was detected is achieved by ascertaining an area of said premises in which said motion detector is deployed.

5. A combined motion detection and access control method according to claim 1 and wherein said broadcasting, by said mobile transceiver associated with said individual, an encoded identification of said individual together with said encoded area identification is operative to attest to the presence of said individual in said area of said premises encoded in said encoded area identification.

6. A combined motion detection and access control system according to claim 5 and wherein said processor is a computing device.

7. A combined motion detection and access control system comprising:

a processor operable for receiving an indication of motion detection within a premises and ascertaining an area of said premises within which said motion was detected;

at least one transmitter communicating with said processor and operable, responsive to said receiving, from said processor, an indication of said area of said premises within which said motion was detected, for broadcasting, within said area within which said motion was detected, an encoded identification of said area within which said motion was detected;

at least one mobile transceiver being associated with an individual and being operable:

for receiving said encoded area identification of said area within which said motion was detected broadcasted by said at least one transmitter; and responsive to said receiving said encoded area identification of said area within which said motion was detected, for broadcasting an encoded identification of said individual together with said encoded area identification of said area within which said motion was detected; and at least one receiver operable:

for receiving said broadcasted encoded identification of said individual together with said broadcasted encoded area identification of said area within which said motion was detected; and for communicating said encoded identification of said individual together with said encoded area identification of said area within which said motion was detected to said processor;

wherein said processor is operable, responsive to said receiving said encoded identification of said individual together with said encoded area identification of said area within which said motion was detected for ascertaining whether said individual is allowed access to said area of said premises encoded in said encoded area identification of said area within which said motion was detected.

8. A combined motion detection and access control system according to claim 7 and wherein said processor is also operable, responsive to said ascertaining that said individual is not allowed access to said area of said premises encoded in said encoded area identification, for providing an indication of unauthorized access to said area.

9. A combined motion detection and access control system according to claim 7 and wherein said processor is a component of an intrusion detection system.

10. A combined motion detection and access control system according to claim 7 and wherein said processor is a component of an enterprise-wide access control system.

11. A combined motion detection and access control system according to claim 7 and wherein said processor communicates with an intrusion detection system.

12. A combined motion detection and access control system according to claim 7 and wherein said processor communicates with an enterprise-wide access control system.

13. A combined motion detection and access control system according to claim 7 and wherein said indication of motion detection is provided by a motion detector deployed within a particular area of said premises.

14. A combined motion detection and access control system according to claim 13 and wherein said ascertaining an area of said premises within which said motion was detected is achieved by ascertaining an area of said premises in which said motion detector is deployed.

15. A combined motion detection and access control system according to claim 7 and wherein said broadcasting, by said at least one mobile transceiver associated with said individual, an encoded identification of said individual together with said encoded area identification is operative to attest to the presence of said individual in said area of said premises encoded in said encoded area identification.

16. A combined motion detection and access control method comprising:

receiving an indication of motion detection within a premises and ascertaining an indication of a room within said premises within which said motion was detected;

responsive to said ascertaining said room of said premises within which said motion was detected, broadcasting, within said room within which said motion was detected, an encoded identification of said room within which said motion was detected;

receiving, by a mobile transceiver associated with an individual present in said room, said broadcasted encoded room identification of said room within which said motion was detected;

responsive to said receiving said encoded room identification of said room within which said motion was detected, broadcasting, by said mobile transceiver associated with said individual present in said room, an encoded identification of said individual present in said room together with said encoded room identification of said room within which said motion was detected;

receiving said broadcasted encoded identification of said individual present in said room together with said broadcasted encoded room identification of said room within which said motion was detected; and responsive to said receiving said encoded identification of said individual present in said room together with said encoded room identification of said room within which said motion was detected, ascertaining whether said individual present in said room is allowed access to said room of said premises encoded in said encoded room identification within which said motion was detected and within which said individual is present.

17. A combined motion detection and access control system comprising:

a processor operable for receiving an indication of motion detection within a premises and ascertaining a room of said premises within which said motion was detected;

at least one transmitter communicating with said processor and operable, responsive to said receiving, from said processor, an indication of said room of said premises within which said motion was detected, for broadcasting, within said room within which said motion was detected, an encoded identification of said room within which said motion was detected;

at least one mobile transceiver being associated with an individual present in said room and being operable:

for receiving said encoded room identification of said room within which said motion was detected broadcasted by said at least one transmitter; and responsive to said receiving said encoded room identification of said room within which said motion was detected, for broadcasting an encoded identification of said individual present in said room together with said encoded room identification of said room within which said motion was detected; and at least one receiver operable:

for receiving said broadcasted encoded identification of said individual present in said room together with said broadcasted encoded room identification of said room within which said motion was detected; and for communicating said encoded identification of said individual present in said room together with said encoded room identification of said room within which said motion was detected to said processor;

wherein said processor is operable, responsive to said receiving said encoded identification of said individual present in said room together with said encoded room identification of said room within which said motion was detected, for ascertaining whether said individual present in said room is allowed access to said room of said premises encoded in said encoded room identification of said room within which said motion was detected and within which said individual is present.

* * * * *